US012018446B2

(12) United States Patent
Brade

(10) Patent No.: US 12,018,446 B2
(45) Date of Patent: Jun. 25, 2024

(54) SECTIONAL REINFORCED CONCRETE SEAWALL

(71) Applicant: Donald E. Brade, Kinde, MI (US)

(72) Inventor: Donald E. Brade, Kinde, MI (US)

( * ) Notice: Subject to any disclaimer, the term of this patent is extended or adjusted under 35 U.S.C. 154(b) by 0 days.

(21) Appl. No.: 18/375,322

(22) Filed: Sep. 29, 2023

(65) Prior Publication Data

US 2024/0026622 A1 Jan. 25, 2024

Related U.S. Application Data

(63) Continuation-in-part of application No. 17/443,664, filed on Jul. 27, 2021, now Pat. No. 11,773,553.

(60) Provisional application No. 63/057,198, filed on Jul. 27, 2020.

(51) Int. Cl.

| | |
|---|---|
| ***E02B 3/06*** | (2006.01) |
| ***E02B 3/14*** | (2006.01) |
| ***E02D 29/02*** | (2006.01) |

(52) U.S. Cl.

CPC ..... *E02B 3/06* (2013.01); *E02B 3/14* (2013.01); *E02D 29/0266* (2013.01)

(58) Field of Classification Search

CPC ..... E02B 3/06; E02B 3/04; E02B 3/14; E02B 3/129; B28B 23/024; Y02A 10/11; Y02A 10/26; E02D 29/0266

See application file for complete search history.

(56) References Cited

U.S. PATENT DOCUMENTS

| | | | |
|---|---|---|---|
| 1,993,291 | A | 3/1935 | Vermont |
| 4,498,805 | A | 2/1985 | Weir |
| 4,776,725 | A | 10/1988 | Brade |
| 5,746,036 | A | 5/1998 | Angelette |
| 6,669,403 | B2 | 12/2003 | Clark et al. |
| 7,007,620 | B2 | 3/2006 | Veazey |
| 7,588,390 | B2 | 9/2009 | Kelley |
| 9,903,080 | B2 | 2/2018 | Minton |
| 10,400,407 | B2 | 9/2019 | Minton |
| 2008/0138155 | A1 | 6/2008 | Kelley |

*Primary Examiner* — Carib A Oquendo

(74) *Attorney, Agent, or Firm* — Brooks Kushman P.C.

(57) ABSTRACT

A wall includes a central hub having an axis extending in a longitudinal direction and three circumferentially spaced walls extending radially from the central hub. Each of the walls is made of cast concrete reinforced with a rebar cage having a plurality of longitudinally spaced pairs of parallel rebars extending radially from the central hub to an end rebar that extends perpendicularly relative to the parallel rebars. Each end rebar is connected to radially outer ends of one of the pairs of parallel rebars. A seawall comprises a plurality of the walls connected together end-to-end with a cable, and connecting plates fastened to adjacent sections. A form for manufacturing the wall encloses connected rebars and is filled with concrete.

6 Claims, 14 Drawing Sheets

SECTIONAL REINFORCED CONCRETE SEAWALL

REFERENCE TO RELATED APPLICATIONS

This application is a continuation-in-part of U.S. Ser. No. 17/443,664 filed Jul. 27, 2021, now U.S. Pat. No. 11,773,553 issued Oct. 3, 2023, which claims the benefit of U.S. provisional application Ser. No. 63/057,198 filed Jul. 27, 2020, the disclosure of which is hereby incorporated in its entirety by reference herein.

TECHNICAL FIELD

This disclosure relates to a reinforced concrete seawall, or wall, made in sections with three circumferentially spaced wall sections radially outwardly extending from a hub.

BACKGROUND

Seawalls are used to control erosion of the land adjacent bodies of water by breaking up waves that would otherwise wash away soil and infrastructure. A sectional seawall is disclosed in applicant's prior U.S. Pat. No. 4,776,725. This application is directed to improvements in sectional seawall s.

Seawalls must be durable to withstand the wave action for an extended period of time. Seawalls must also prevent leakage between the sections that can erode soil behind the seawall and weaken the seawall.

Forms are constructed to form the seawall, or wall, sections by assembling rebar inside the form before pouring concrete into the forms. After curing the concrete, the forms are disassembled and cleaned for reuse. The heavy seawall, or wall, sections are difficult to move and the forms must remain in place until the cast section is substantially cured. The forms are generally assembled with conventional concrete form walls and fasteners in a time-consuming assembly process.

The method of making the seawall sections disclosed in my prior patent included joining a plurality of V-shaped reinforcing bars that are welded together with longitudinally extending reinforcing bars. The V-shaped bars include a longer leg and a shorter leg. The shorter leg is joined at the terminal end of the shorter leg to an intermediate location on the longer leg. The terminal end of the longer bar is fixed to a longitudinally extending reinforcing bar. The V-shaped reinforcing bars are also welded to longitudinally extending bars within the hub and are also welded at a mid-portion of the legs. While the prior method produced an effective seawall, or wall, a more efficient method of producing a more durable seawall, or wall, is desired.

Extreme weather conditions are occurring with greater frequency such as tropical storms and hurricanes. Seawalls may be impacted by such conditions and need to be stronger and more durable.

This disclosure is directed to solving the above problems and other problems as summarized below.

SUMMARY

According to one aspect of this disclosure a seawall section, or wall, is disclosed that comprises a central hub having an axis extending in a longitudinal direction. Circumferentially spaced walls extending radially from the central hub, each of the walls being made of cast concrete reinforced with a rebar cage having a plurality of longitudinally spaced pairs of parallel rebars extending radially from the central hub to an end rebar that extends perpendicularly relative to the parallel rebars, wherein each of the end rebars are connected to radially outer ends of one of the pairs of parallel rebars. A plurality of longitudinally spaced rings are disposed about the central hub, with a first set of the rings attached to the rebar cage and a second set of the rings attached to a plurality of ring supporting rebars that extend the longitudinal direction.

According to other aspects of this disclosure, the rebar cage may include longitudinally extending rebars connected to the end rebars. The end rebars are connected at the outer ends of the parallel rebars. The end rebars are welded to the longitudinally extending rebars.

The rebar cage may include intermediate rebars connected to the parallel rebars between and spaced from the central hub and the end rebars. The parallel rebars may be connected to each other within the central hub by a hub rebar web encircling the axis of the central hub.

A connector may be provided that has two ends that are tapered from a central portion having a diameter D that is larger than the outer ends of the connector having a dimeter less than the diameter D, wherein two adjacent seawall sections define tapered openings adapted to receive half of the connector.

At least three of the spaced pairs of the parallel rebars are longitudinally spaced from each other to reinforce the cast concrete at longitudinally spaced locations.

The connector may have two ends that are tapered to be reduced in diameter relative to a central portion of the connector, wherein the seawall section defines two tapered openings are provided on opposite ends of the seawall section that are each adapted to receive half of one of the connectors.

A pipe may be aligned with the axis and disposed within a central opening defined by the hub and extending in a longitudinal direction.

According to another aspect of this disclosure, seawall is disclosed that comprises a plurality of seawall sections, each of the seawall sections including central hub having an axis extending in a longitudinal direction. Three circumferentially spaced walls extend radially from the central hub that are made of cast concrete reinforced with a rebar cage having a plurality of longitudinally spaced parallel rebars extending radially from the central hub. A pipe is aligned with the axis and disposed with in a central opening defined by the hub that extends in a longitudinal direction, wherein the rebar cage includes a plurality of longitudinally spaced rings encircling the pipe. A plurality of connectors are attached on opposite ends to two adjacent seawall sections. A cable extends along the axis through the connectors and the central hubs of the seawall sections.

The rings may include a first set of rings attached to the rebar cage and a second set of rings attached to longitudinally extending rebars, wherein the second set of rings are nested inside the first set of rings.

A gasket formed of an elastic material may be provided between adjacent seawall sections to prevent leakage between the adjacent sections. The gasket includes a hub section and wall joining sections to form a seal between adjacent seawall section walls.

According to another aspect of this disclosure, a form for manufacturing a seawall section, or wall, is disclosed. The form includes a base including a planar plate that defines a plurality of holes. A plurality of V-shaped walls are attached at a lower end of the walls to the base with the walls being joined together to define a hub-forming space. A plurality of end walls are each secured to the radially outer ends of two adjacent V-shaped walls with a plurality of releasable fasteners. A top plate is attached to a top end of the V-shaped walls. A first tube locating protrusion is provided on the base and a second tube locating protrusion is provided on a lower surface of the top plate. First and second tube locating protrusions are adapted to retain a pipe inside the hub forming space. A plurality of spacers is assembled between adjacent V-shaped walls in alignment with two openings defined by the adjacent V-shaped sidewalls. A plurality of fasteners each secure two of the V-shaped walls to one of the spacers.

According to other aspects of the form for manufacturing the seawall section, or wall, the base may further comprise a set of channels provided on the lower surface of the base that are adapted to receive forklift tines. The base may define access openings proximate each of the plurality of holes for providing access to the lower side of the base for fastening and unfastening the V-shaped walls to the base. The spacers may be tapered from a first end to a second end of the spacers to facilitate removing the spacers from the seawall section.

The releasable fasteners may include pivotable bolts that extend between the end walls and the V-shaped walls, wherein a nut assembled to each of the pivotable bolts secures the V-shaped walls to the end walls. The form may further comprise a rebar cage received within the V-shaped walls. The rebar cage may include a plurality of longitudinally spaced pairs of parallel rebars with each pair extending radially from the central hub to an end rebar that extends perpendicularly relative to the parallel rebars. The end rebars may be connected to radially outer ends of one of the pairs of parallel rebars.

Another aspect of this disclosure relates to a method of making a seawall section, or wall. The method comprises the steps of assembling a rebar cage and welding the rebar cage together. The rebar cage has a plurality of longitudinally spaced pairs of parallel rebars each pair extending radially from a central hub to an end rebar that extends perpendicularly relative to the parallel rebars. The end rebars are connected to radially outer ends of one of the pairs of parallel rebars. Placing the rebar cage on a base. Attaching a plurality of V-shaped walls to the base around the rebar cage. The V-shaped walls define spacer attachment openings. Inserting spacers between two adjacent V-shaped walls in alignment with the spacer attachment openings. Securing the spacers with fasteners to hold the V-shaped walls together. Assembling an end wall to two adjacent V-shaped walls and filling a casting space defined by the V-shaped walls, the end plates, and the spacers with a concrete mixture.

According to other aspects of the method of making a seawall section, the method may further comprise securing a pipe within the central hub to a first protrusion attached to the base and a second projection attached to a top plate.

The step of attaching the V-shaped walls may further comprise attaching one of the V-shaped walls to the base before placing the rebar cage on the base and attaching the other V-shaped walls to the base to enclose the rebar cage.

The step of inserting spacers between adjacent V-shaped walls may further comprise holding the spacers with an elongated member having at least one magnet at one end that magnetically retains one of the spacers between the V-shaped walls and in alignment with the spacer attachment openings.

The method of making a seawall section may further comprise curing the concrete mixture to form the seawall section, disassembling the V-shaped walls from the seawall section and the base, and removing the spacers from the seawall section.

The above aspects of this disclosure and other aspects will be described below with reference to the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
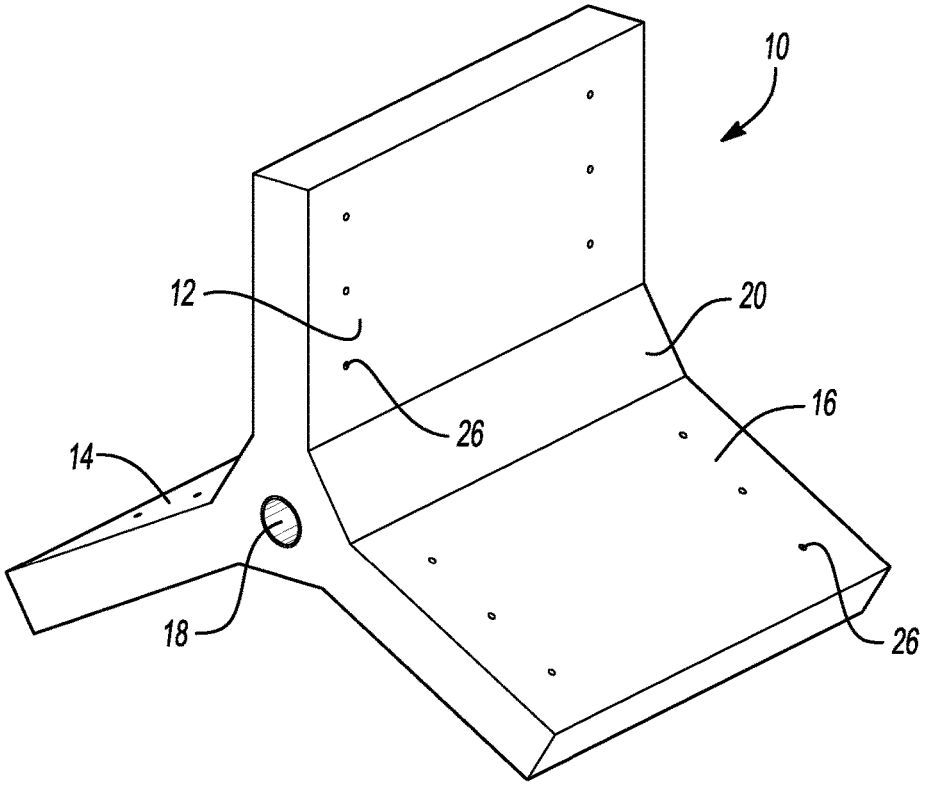
FIG. 1 is a perspective view of a seawall section made according to one embodiment of this disclosure.
Figure 2:
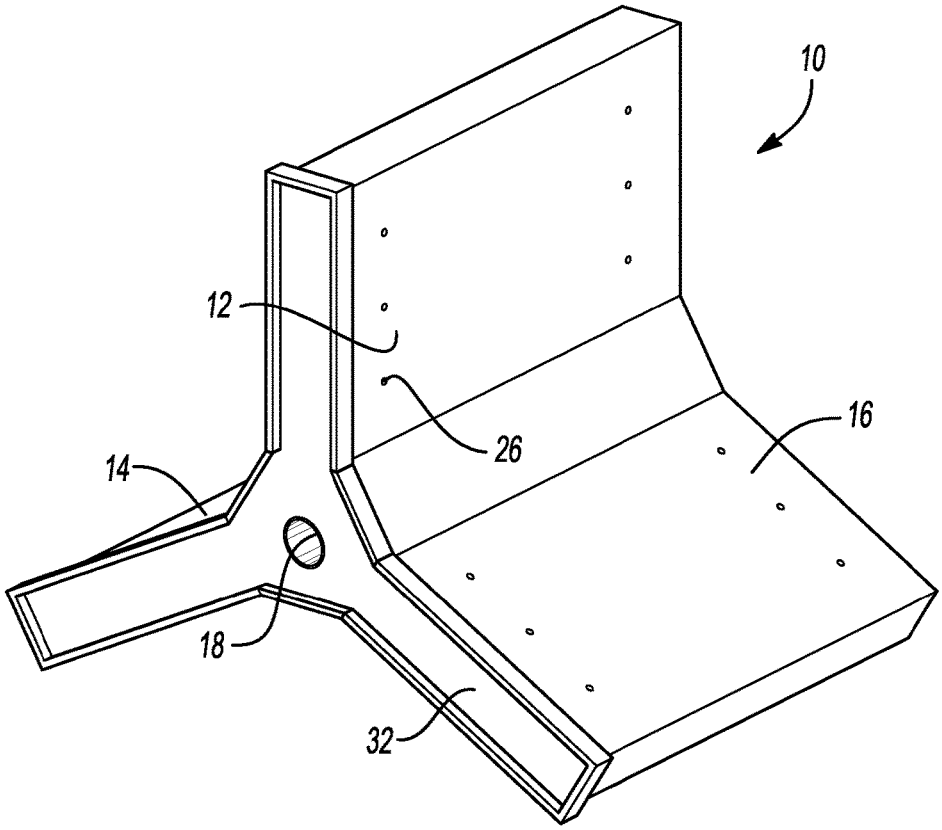
FIG. 2 is a perspective view of a seawall section including a gasket on one end made according to one embodiment of this disclosure.

Referring to FIGS. 1 and 2, a seawall section 10, or wall, is illustrated that includes a top wall 12, a lower rear wall 14, and a lower front wall 16. A pipe 18 is embedded in and extends longitudinally through a central hub 20. The pipe 18 is adapted to receive a cable 22 (shown in FIG. 3) that is used to secure a plurality of seawall section 10 together, A plurality of holes 26 are formed in each of the walls 12, 14, and 16 that are adapted to receive a fastener 28 (shown in FIGS. 6 and 7) that is adapted to secure attachment plates 30. (also shown in FIGS. 6 and 7) A gasket 32 is shown attached to one end of the seawall section 10 that is provided to seal between two adjacent seawall sections 10.

Figure 3:
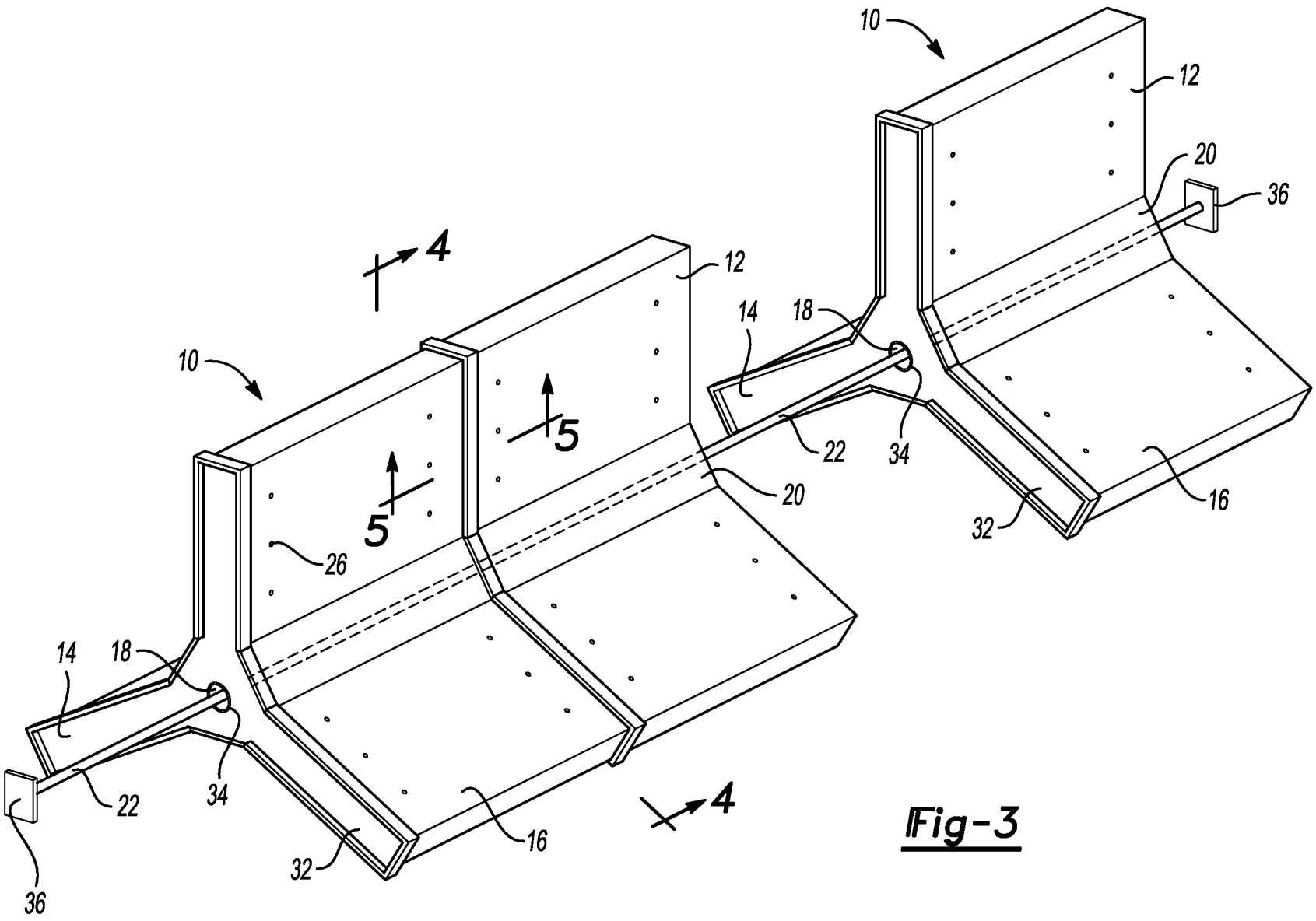
FIG. 3 is a perspective view of three seawall sections with one section being shown as it is assembled to two previously assembled sections with a cable being routed through the sections.

Referring to FIG. 3, three seawall sections 10, or walls, are illustrated with two seawall sections 10 being secured together with a gasket 32 between the sections 10. A third seawall section 10 with a gasket 32 attached to one end is shown in position to be assembled to the two assembled seawall sections 10. A cable 22 is routed through the pipes 18 in the seawall sections 10 and openings 34 defined by the gaskets 32. Cable end tensioners 36 are attached to the cable 22. While end plates are shown in FIG. 4, other types of cable tensioning devices could be used for tensioning and securing the ends of the cable 22 to the outermost seawall sections 10 in a group of seawall sections 10.

Figure 4:
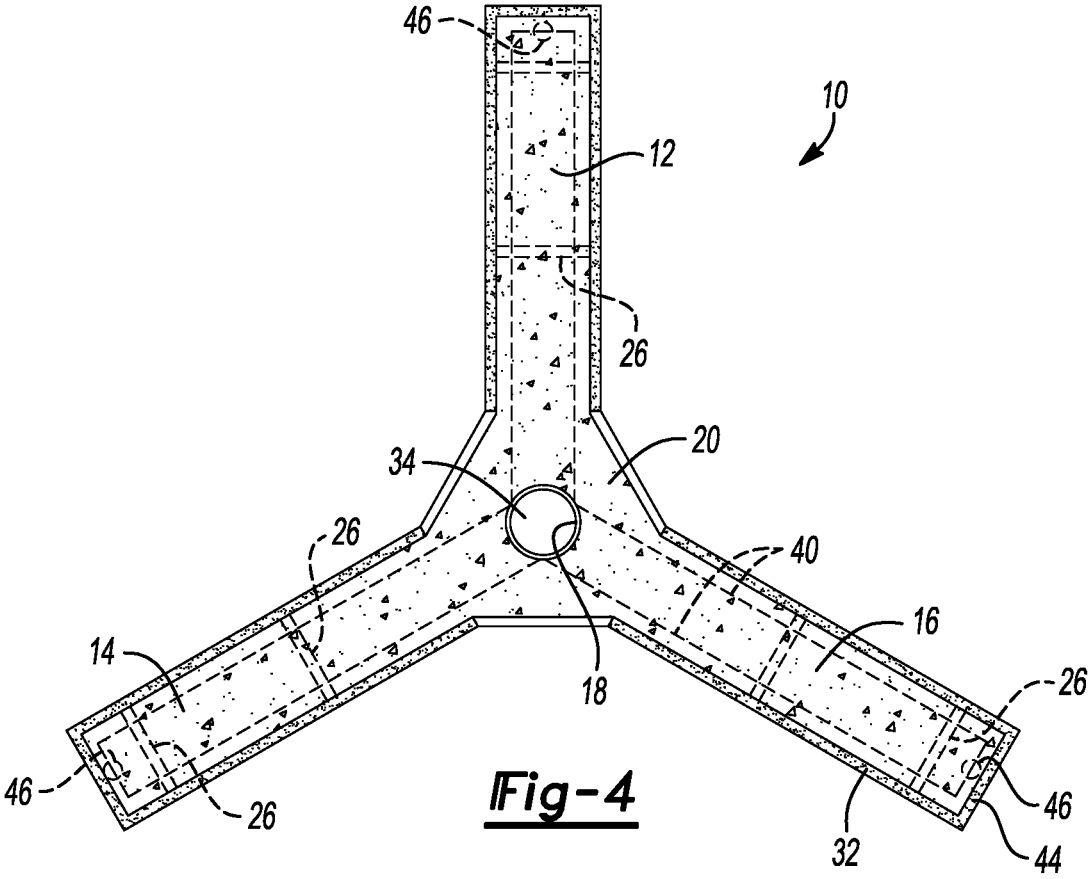
FIG. 4 is a cross-sectional view taken along the line 5-5 in FIG. 3.
Figure 5:
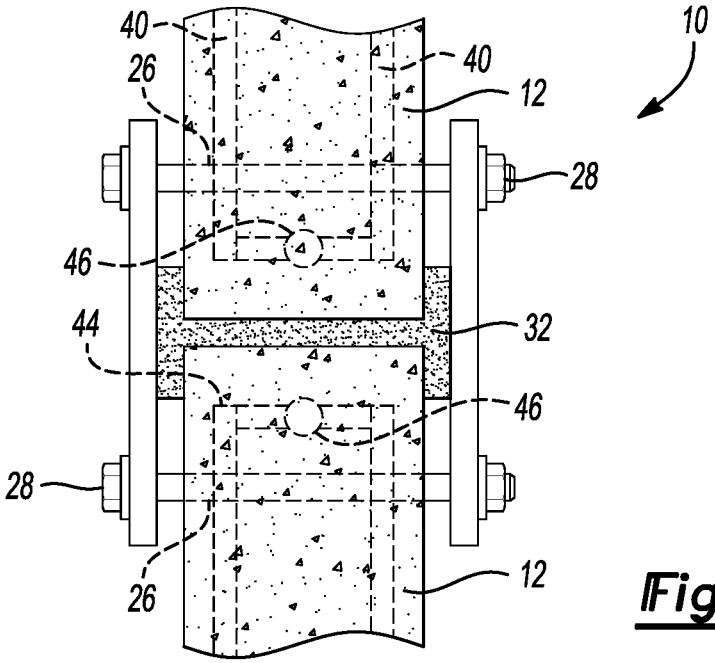
FIG. 5 is a fragmentary cross-section view taken along the line 6-6 in FIG. 3.

Referring to FIGS. 4-5, the seawall section 10 is shown in cross section. The seawall section 10 is formed of concrete reinforced by a rebar cage 38 shown in phantom lines in FIGS. 4 and 5. The rebar cage 38 includes parallel legs 40 that extend radially outwardly from the central hub 20 of the seawall section 10 in which the parallel legs are encased in concrete. The legs are recessed from the outer surface of the top wall 12, lower rear wall 14, and lower front wall 16. An end piece 42 of rebar is connected to the distal ends 44 of the parallel legs 40. The end pieces 42 may be tied to the distal ends 44 by rebar clips or ties or may be welded to the distal ends 44. The end pieces 42 extend in a generally circumferential direction and are recessed from the outer surface of the ends of the walls 12, 14, and 16.

The end piece 42 and legs 40 are structured to reinforce the ends of the walls 12, 14, and 16 are interconnected to form a U-shaped end reinforcement of the rebar cage 38. The holes 26 closest to the distal ends of the walls 12, 14, and 16 are disposed radially inside the end pieces 42. The holes 26 receive the fasteners 28 that are used to secure adjacent seawall sections 10 together with the attachment plates 30 that are secured to opposite side of the top wall 12. The fasteners 28 and attachment plates 30 are radially inboard of the end pieces 42 and distal ends 44 of the parallel legs 40 of the rebar cage 38 assure that the ends of the concrete walls 12 are reinforced against forces applied to the seawall that would tend to separate the seawall sections 10.

The end pieces 42 include a longitudinally extending (when deployed as a seawall) end rebar 46 and several end links 48 that extend perpendicular to the end rebar 46. When the rebar cage 18 is set up for casting the concrete, the end rebar 46 extends vertically through the form and the end links 48 extend in the horizontal direction. Two to five sets of parallel legs 40 may be stacked and spaced from each other in the vertical direction in the form before casting the concrete. It should be understood that the sets of parallel legs 40 are spaced horizontally when the seawall section 10 is set in place to form the seawall.

Figure 6:
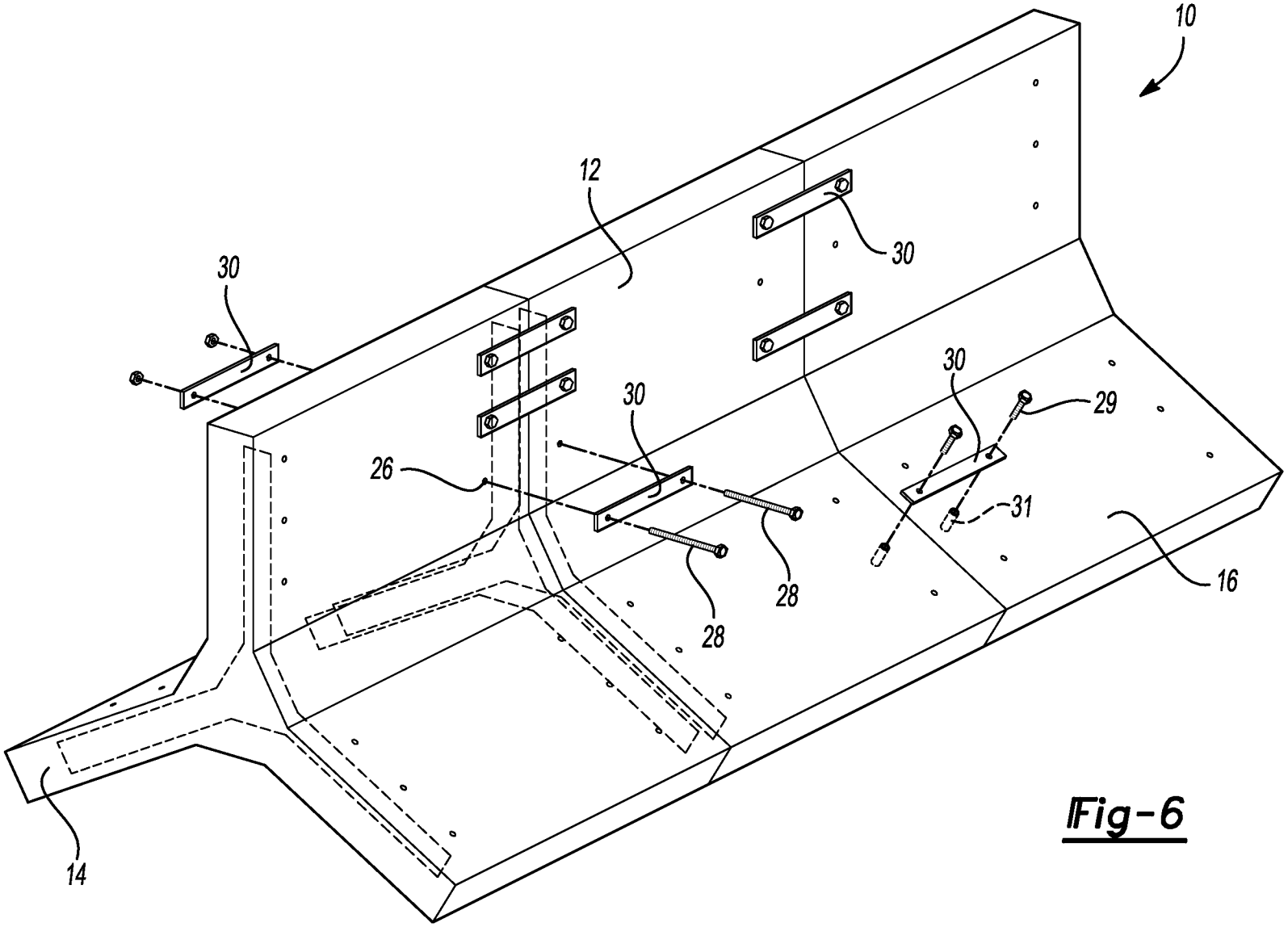
FIG. 6 is a perspective view of three seawall sections according to another embodiment of this disclosure being secured together with plates fastened to the inner and outer surfaces of the upper wall.

Referring to FIG. 6, three seawall sections 10 are secured together with two or three attachment plates 30 being secured to two adjacent seawall sections 10 with the fasteners 28. In the embodiment illustrated in FIG. 6, there is no pipe 18 or cable used to secure the seawall sections 10 together. The fasteners 28 extend through the top wall and are disposed inside the parallel legs 40 of rebar so that the rebar cage reinforces the ends of the seawall sections 10 and prevents separation of the seawall sections 10.

With continued reference to FIG. 6, the fasteners 28 used to connect the seawall sections 10 are not used to connect two lower front walls 16. Instead, a bolt 29 and an embedded receptacle or nut 31 connect the attachment plates 30 to the two adjacent sections 10. These attachment plates 30 are in addition to the attachment plates installed on the top wall 12 as described in the previous paragraph. The advantage of the bolt 29 and embedded nut 31 is that the connecting plate 30 may be attached from one side of the lower front walls 16 because the opposite side of the lower front walls is inaccessible.

Figure 7:
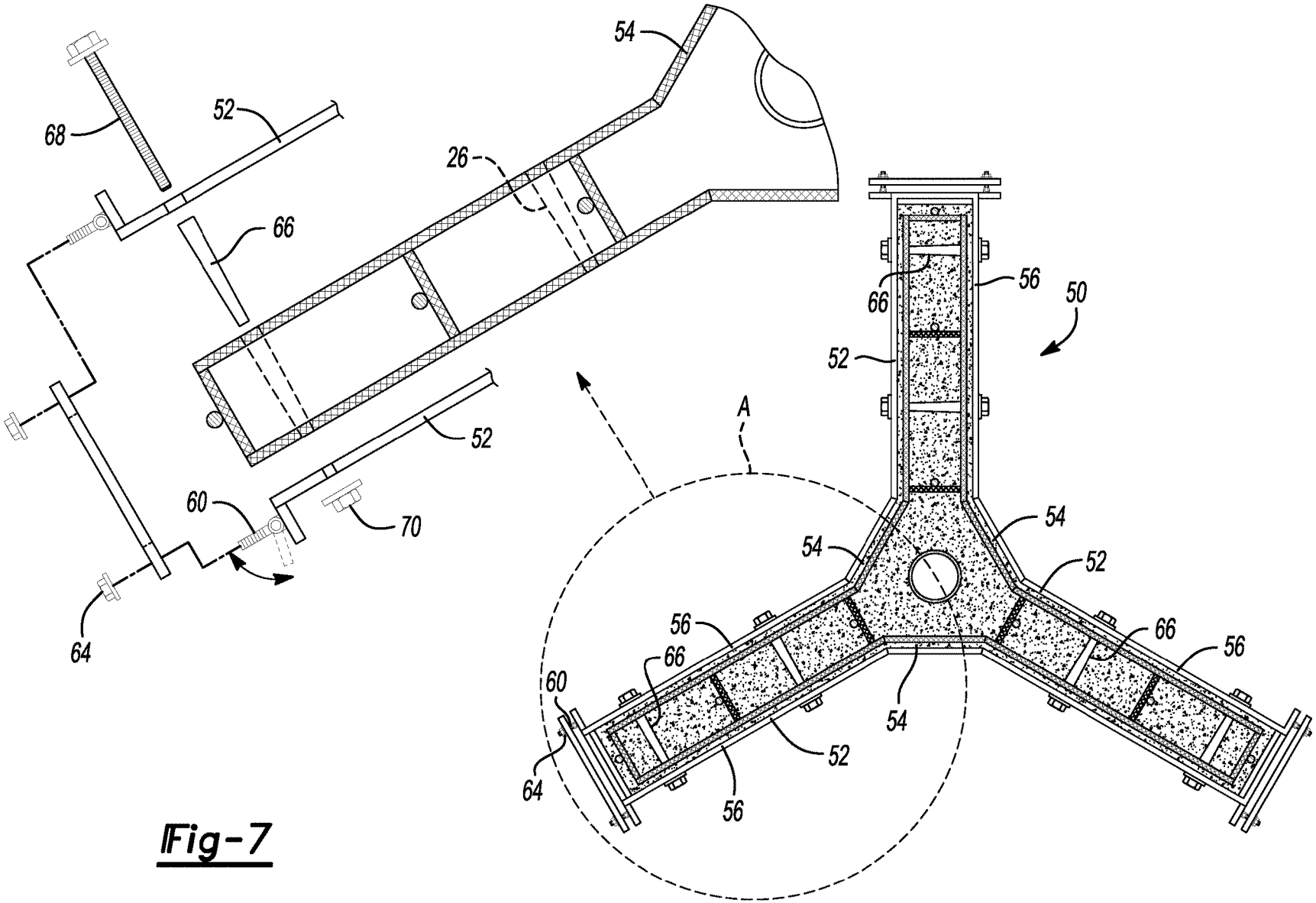
FIG. 7 is a diagrammatic view of one wall of the seawall section showing tapered spacers secured between the side walls of the form and inside the rebar cage.

Referring to FIG. 7, a top plan view of an assembled form 50 is shown with a portion used to form the top leg 12 within the circle "A" being enlarged and exploded apart to illustrate the structure of the form 50. The form includes three form side walls 52 that extend vertically when the form 50 is assembled and ready for pouring the concrete. Each form side wall 52 includes a central form wall 54 and two generally radially extending form walls 56. An end form cap 58 is attached to two adjacent form side walls 52 at the distal ends of the form side walls. The form end caps 58 are secured to pivoting toggle bolts 60 provided on the distal ends of the form side walls 52 that are received in slots 62 (shown in FIG. 8) defined by the end form cap 58. Nuts 64 attached to the pivoting toggle bolts 60 secure the form end caps 58 to the form side walls 52.

Tapered spacers 66 are assembled to the form 50 with form bolts 68 and nuts 70 to hold the form side walls 52 together while the concrete is poured and cured.

Figure 8:
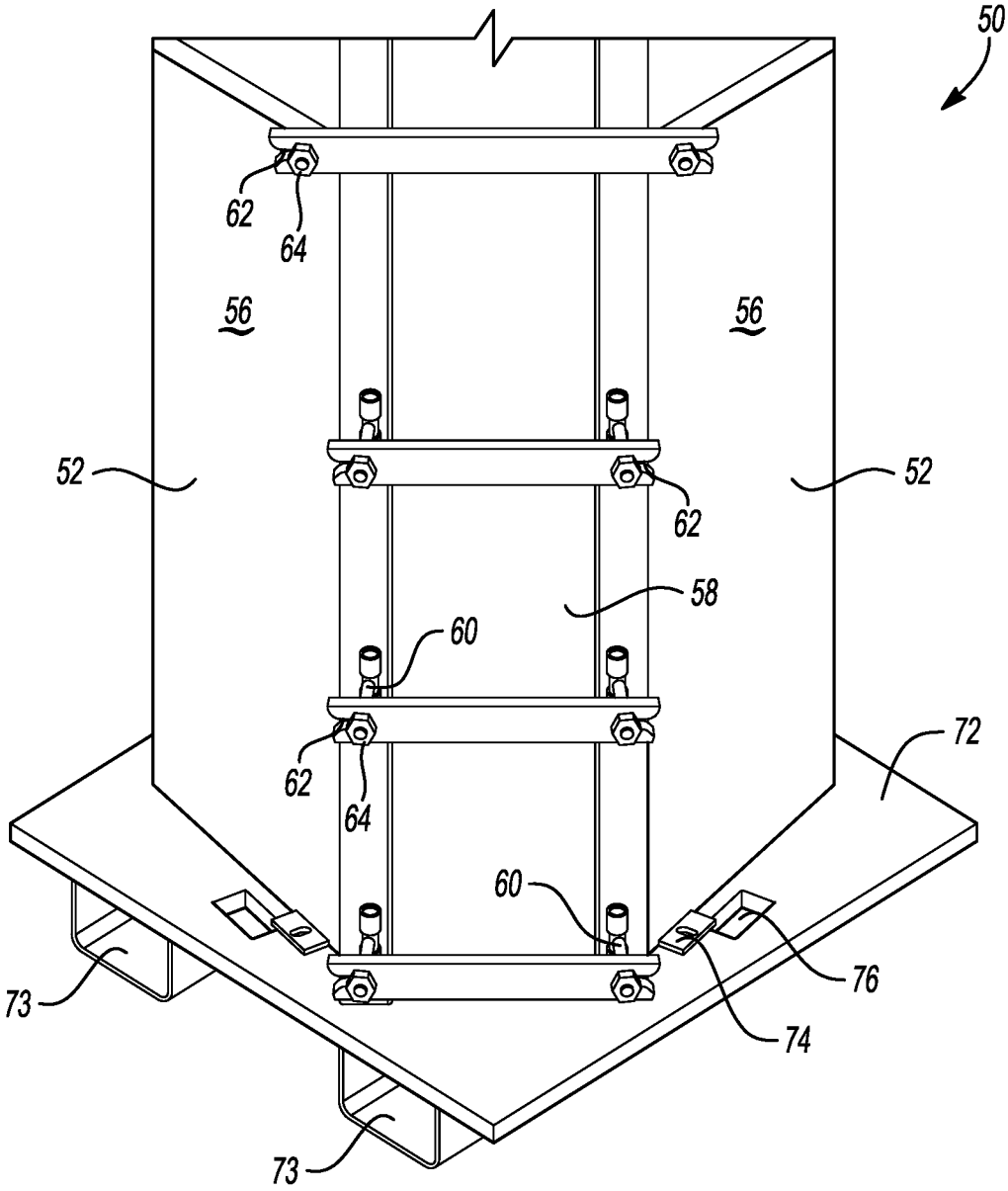
FIG. 8 is an elevation view of an end plate form shown assembled to two side walls of the form.

Referring to FIG. 8, the end form cap 58 is shown attached to two form side walls 52, and a base plate 72. The form 50 is attached to the base plate 72 with base plate flanges 74 and fasteners that may comprise a nut and bolt. An access opening 76 is defined in the base plate 72 adjacent the location where the base plate fasteners 74 are installed to permit the base plate fasteners 74 to be installed and tightened. The base plate 72 may be provided with forklift channels 73 on a bottom surface to facilitate moving the form 50 into position for pouring the concrete and for moving the form after filling and partially curing the seawall section 10. As previously described with reference to FIGS. 6 and 7, the end form cap 58 is attached to the end form cap 58 by inserting the pivoting toggle bolts 60 into the slots 62 and are secured by the nuts 64.

Figure 9:
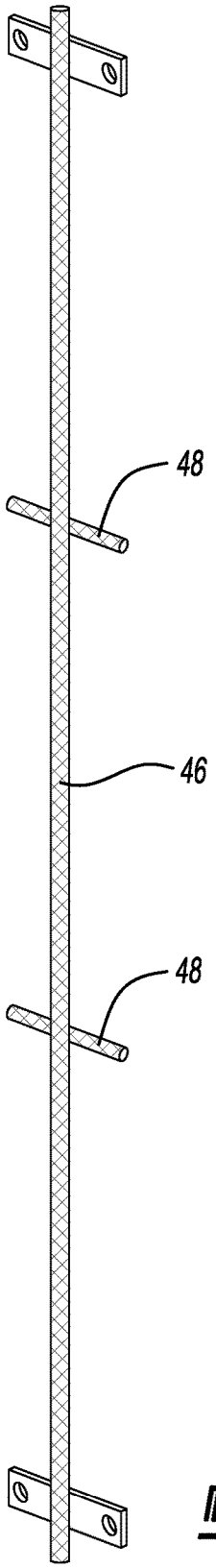
FIG. 9 is a fragmentary perspective view of the end rebar piece with two horizontally oriented rebars in position to be tied to the end rebar piece.

Referring to FIG. 9, the end rebar 46 is shown in isolation with two intermediate end links 48 form of rebar and two end link plates 78. The end rebar 46 may include various combinations of end links 48 and end link plates 78. The end links 48 and end link plates 78 may be welded or tied to the parallel legs 40 of the rebar cage 38.

Figure 10:
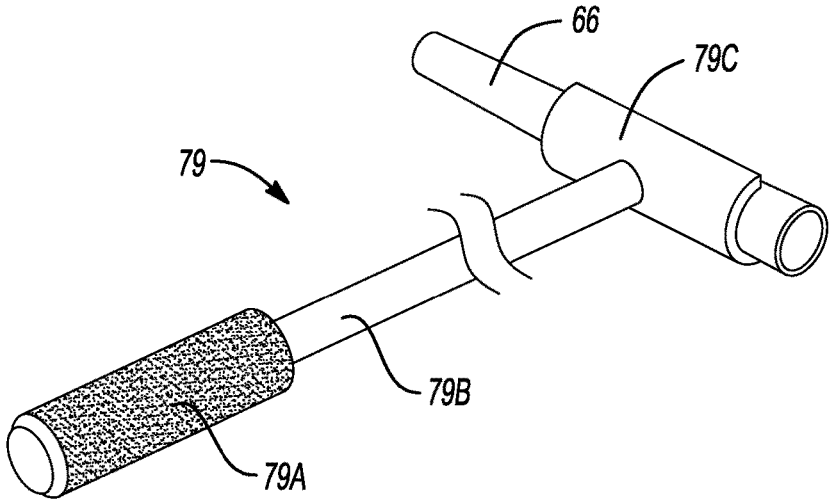
FIG. 10 is a perspective view of an end rebar piece having extensions adapted to be tied to the horizontally oriented rebars as cast.

Referring to FIGS. 7 and 10, the tapered spacers 66 are inserted between the form sidewalls 52 with a magnetic spacer holder 79 and aligned with holes 67 in the radially extending form walls 56. When aligned with the holes 67 defined by the form side walls 52, the bolts 68 are inserted in the tapered spacers 66 to hold the spacers 66 in place and the magnetic spacer holder 79 is detached. The magnetic spacer holder 79 includes a handle 79A at one end of an elongated body 79B. A magnetic holder 79C is attached to the elongated body 79B that holds the tapered spacer 66. The tapered spacers 66, form bolts 68, and nuts 70 are removed after curing the concrete and may be reused. The tapered spacers 66 are tapered to facilitate tapping the spacers out of the seawall sections 10 for reuse.

Figure 11:
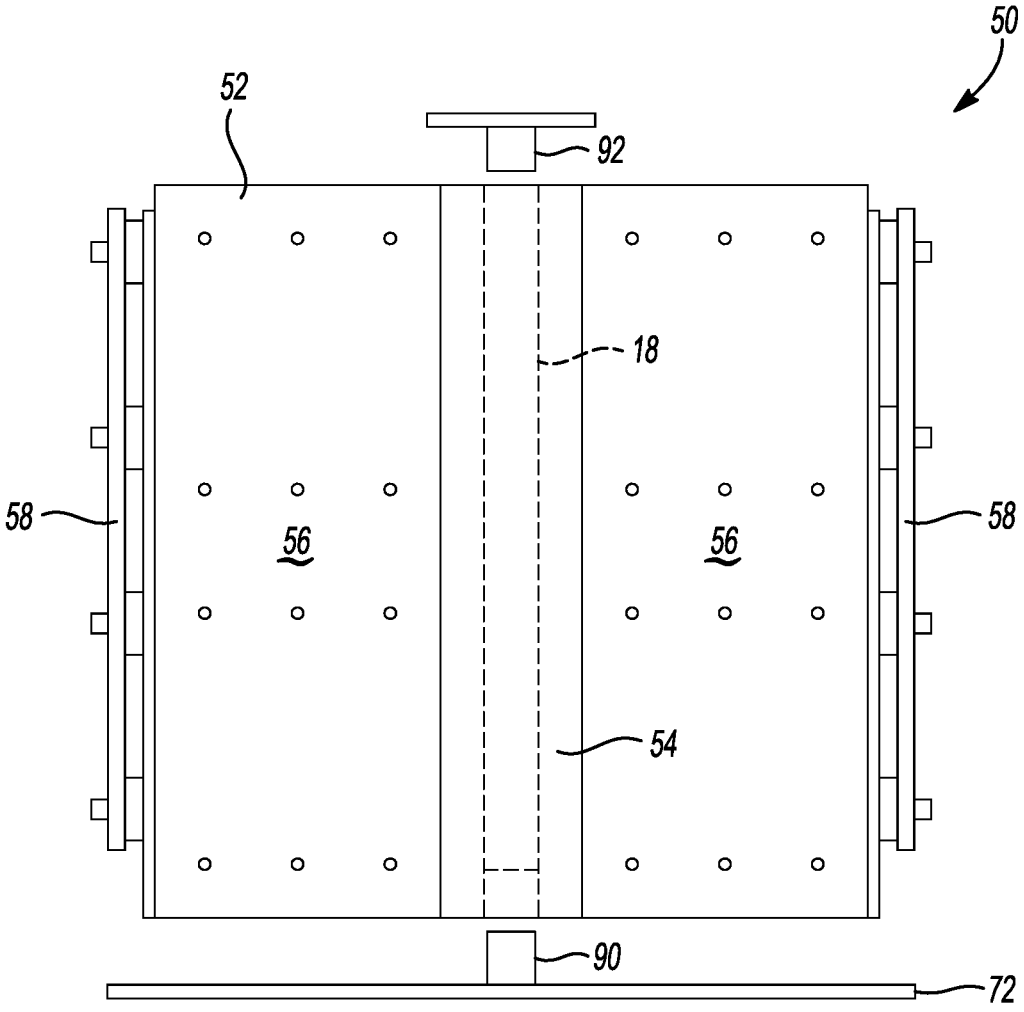
FIG. 11 is a side elevation view of the assembled form with protrusions for retaining a pipe in the central hub area of the form.

Referring to FIG. 11, an assembled form 50 is shown to include a form side wall 52 that includes two radially extending form walls 56 flanking a central form wall 54. Two end form caps 58 are attached to the radially extending form walls 56 on opposite ends of the form 50. A base tube locating protrusion 90 is provided on the base plate 72 and a top tube locating protrusion 92 is assembled to the top of the form 50. The pipe 18 is retained between the base tube locating protrusion 90 and the top tube locating protrusion 92 during the concrete casting step of forming the seawall section 10.

Figure 12:
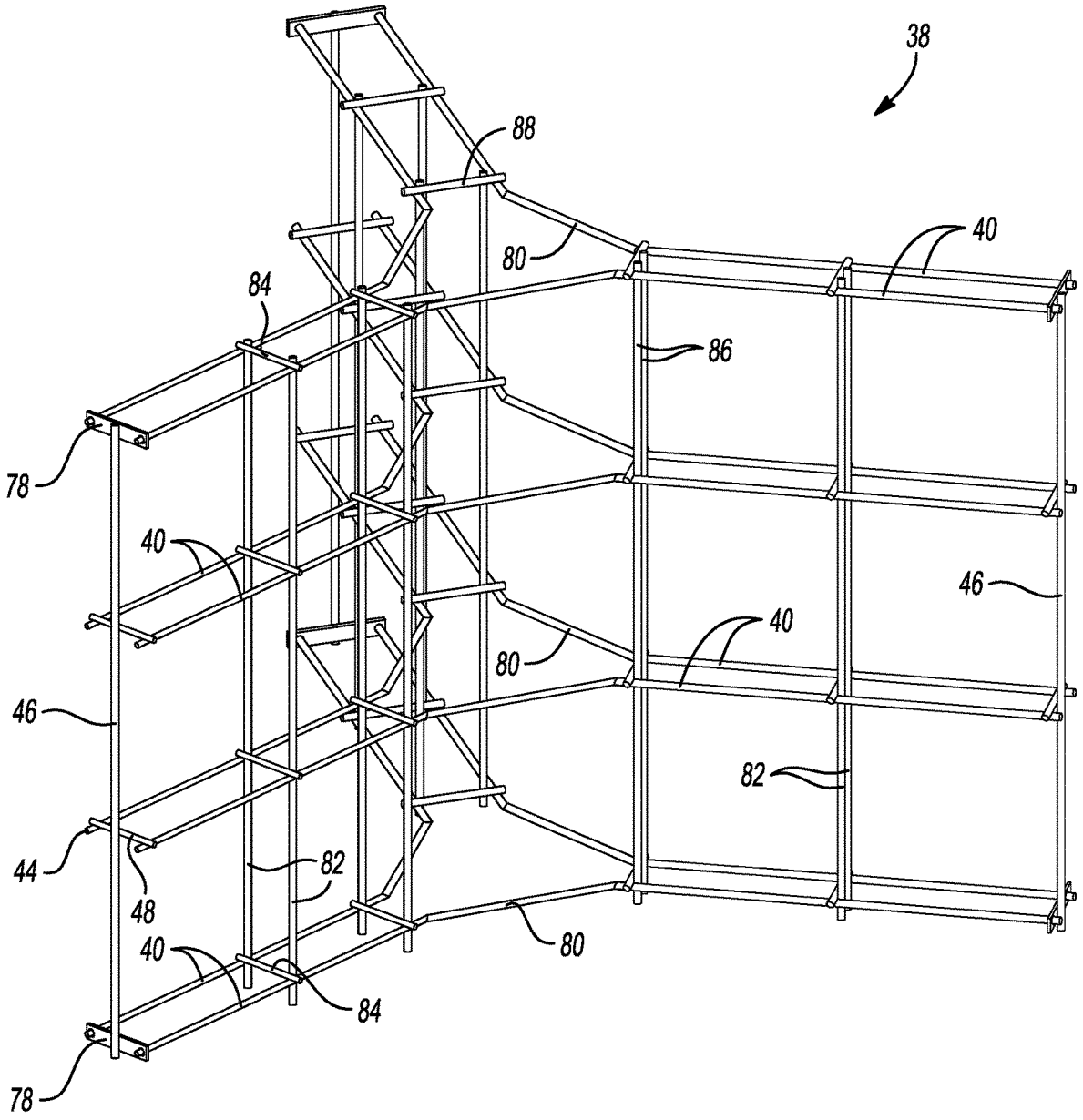
FIG. 12 is a diagrammatic perspective view of an assembled rebar cage for one embodiment of a seawall section.

Referring to FIG. 12, a fully assembled rebar cage 38 is illustrated in the desired orientation for forming the seawall section 10. The end rebars 46 are vertically oriented to hold four sets of parallel legs 40 in a spaced relationship. The parallel legs 40 are joined in the central hub 20 area by central rebars 80 that are generally arranged in a triangular array. An intermediate rebar upright 82 is attached to the parallel legs 40 by rebar links 84 to support the parallel legs 40. A central rebar upright 86 is attached at the radially inner end of the parallel legs 40 by rebar links 88.

Figure 13:
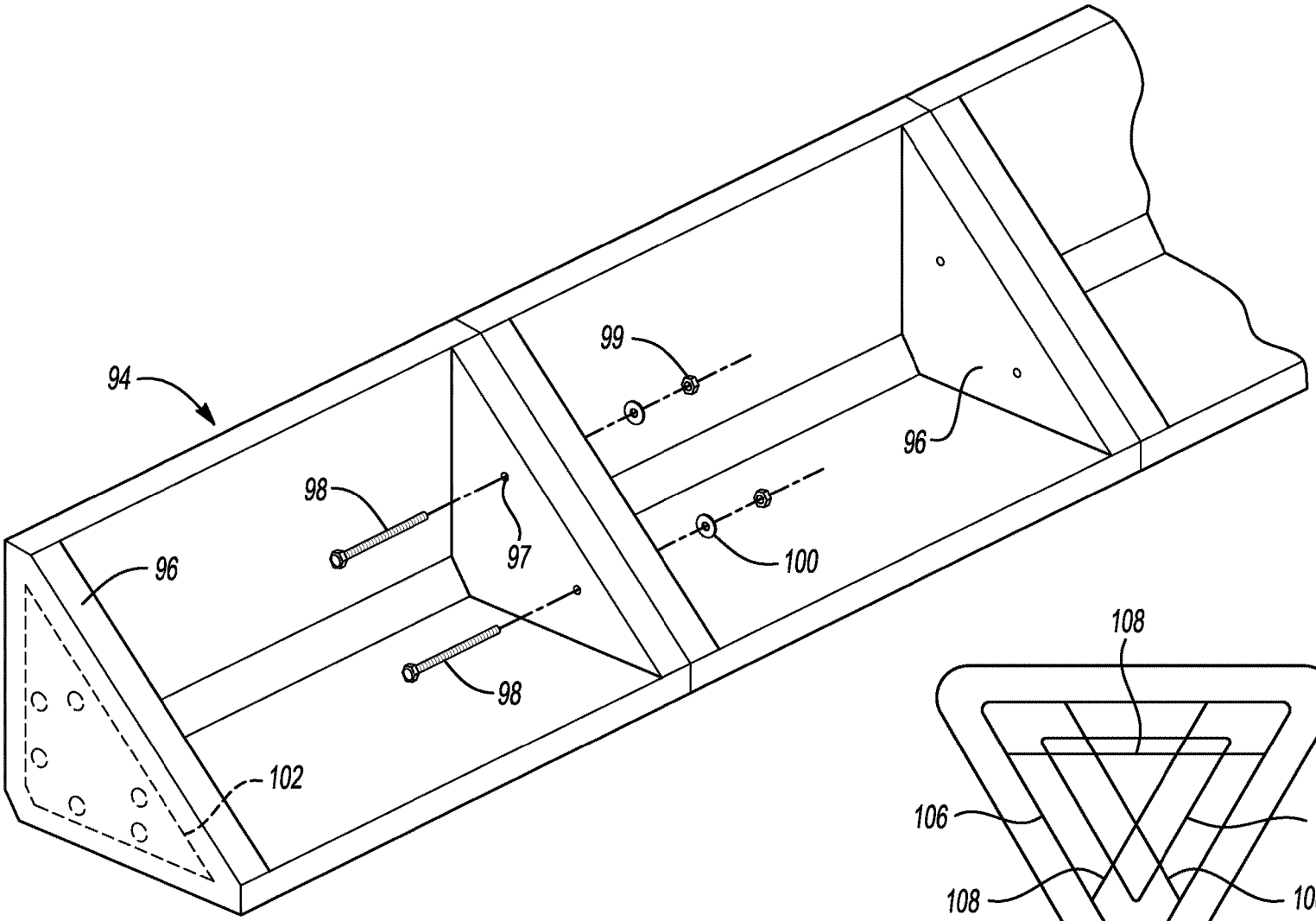
FIG. 13 is a fragmentary perspective view of several sections of a seawall assembled together with two sections in position to be connected by fasteners oriented for inserting the fasteners to connect end walls of two adjacent sections.

Referring to FIG. 13, an alternative embodiment of several seawall sections 94 is illustrated that include a pair of end walls 96 on opposite lateral ends of each section 94. Each seawall section 94 includes a top wall 12, a lower rear wall 14, and a lower front wall 16. Each seawall section 94 includes elements corresponding to the structure of the seawall sections 10 including the top wall 12, lower rear wall 14, and lower front wall 16 that extend radially outwardly from the central hub 20. The end walls 96 of two adjacent seawall sections 94 are secured together after positioning the seawall sections 94 on the ground with several bolts 97 that are inserted through holes 98 defined by the end walls 96. A nut 99 and washer 100 are then attached to the bolt 97 to lock the seawall sections 94 together. The holes 97 are formed by inserting spacers 66 into the form prior to casting the seawall sections 94 and are removed after the concrete is set. The holes 97 are located radially inboard of the rebar 102 in each end wall 96.

Figure 14:
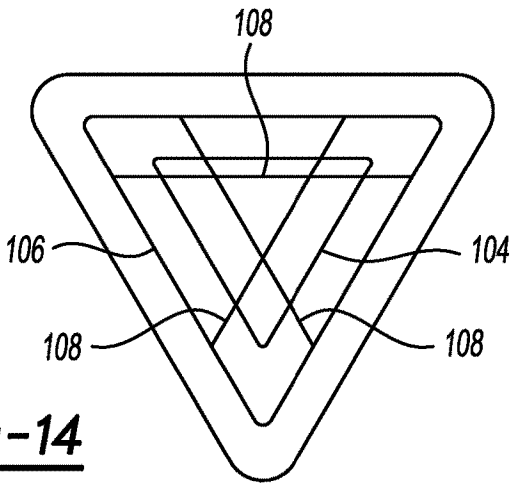
FIG. 14 is a schematic view of an end wall showing the location of the rebar contained within the end wall.

Referring to FIG. 14, in one example, the rebar in each end wall includes an inner triangular shaped rebar 104 and an outer triangular shaped rebar 106 that are connected by three crossing rebars 108.

Figure 15:
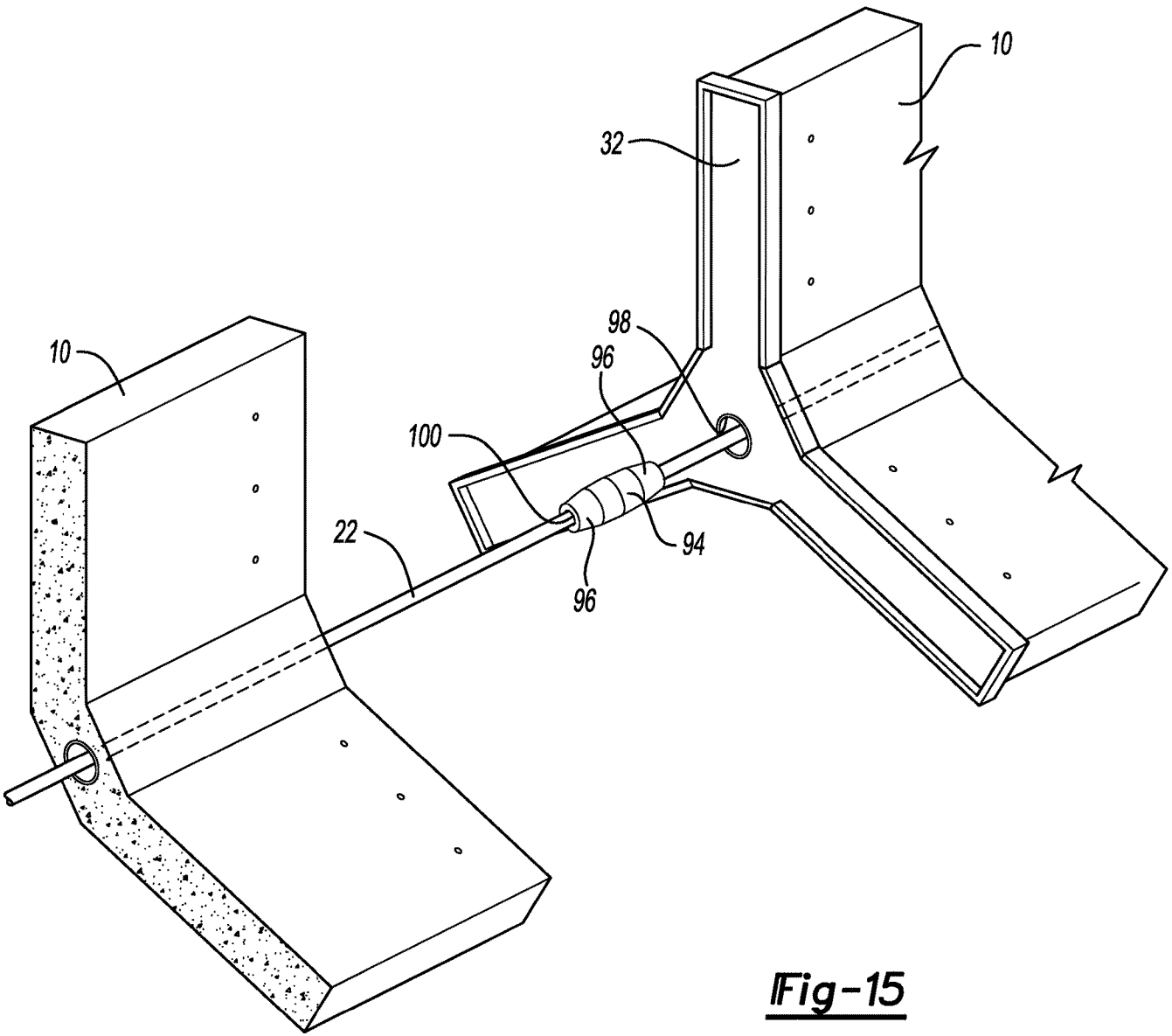
FIG. 15 is a fragmentary view of two seawall sections being secured together with a connector having tapered ends attached to a central cable and adapted to be received with half of the connector being received in each of the two seawall sections.

Referring to FIGS. 15-19, an alternative embodiment of a pair of seawall sections 10 is disclosed that are adapted to be assembled with a connector 94 that includes two tapered ends 96. As shown in FIG. 15, each tapered end 96 is received in an opening 98 defined by the seawall sections 10. Each of the openings 98 is adapted to receive half of the connector 94. The connector 94 receives the cable 22 through a central opening 100 defined by the connector 94. The gasket 32 may also be assembled between the two adjacent seawall sections 10 as previously described.

Figure 16:
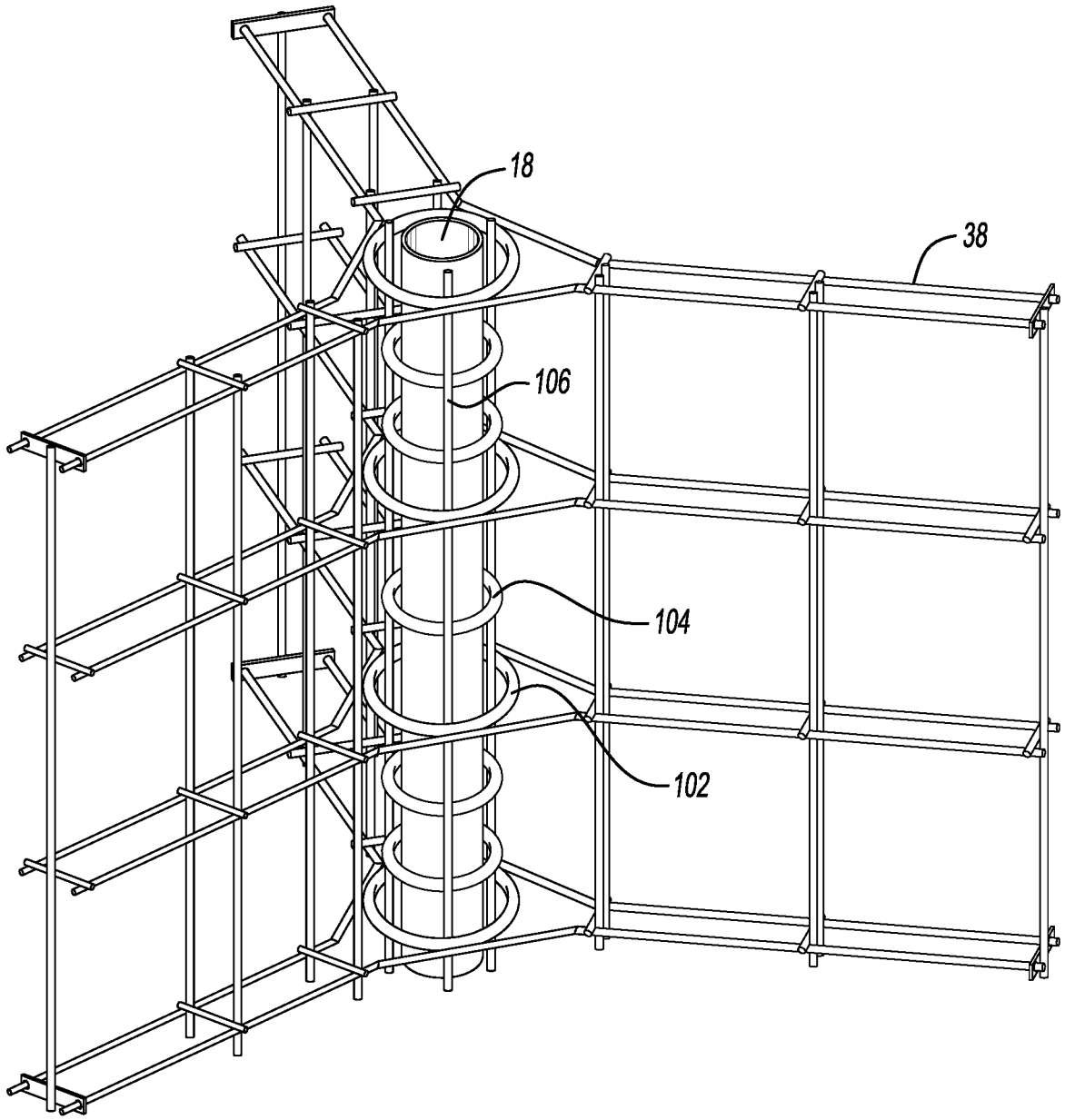
FIG. 16 is a perspective view of a rebar reinforcement structure that is assembled together and then placed in a form as previously described that includes additional reinforcing rings disposed around the central tubular member.

Referring to FIG. 16, a rebar cage 38 is shown that includes a plurality of rings 102 and 104 disposed about the central hub 20 (not shown in FIG. 16) that provide additional reinforcement in the central hub 20. A first set of rings 102 is welded to the rebar cage 38. A second smaller set of rings 104 is connected to a plurality of longitudinally extending hub rebars 106 that form a web of the second rings 104 and the hub rebars 106. The second set of rings 104 are assembled separately from the rebar cage 38 and then assembled with the hub rebars 106 inside the rebar cage 38. The second set of rings 104 is then welded to the first set of rings 102 either directly to each other or with linking pieces of rebar. The pipe 18 is disposed inside the second set of rings 104 and is adapted to receive the cable 22 (not shown in FIG. 16) that is used to tie adjacent seawall sections 10 together. While the primary application of the seawall sections 10 is provide protection from waves, the seawall sections may also be used as a retaining wall or other type of land barrier.

Figure 17:
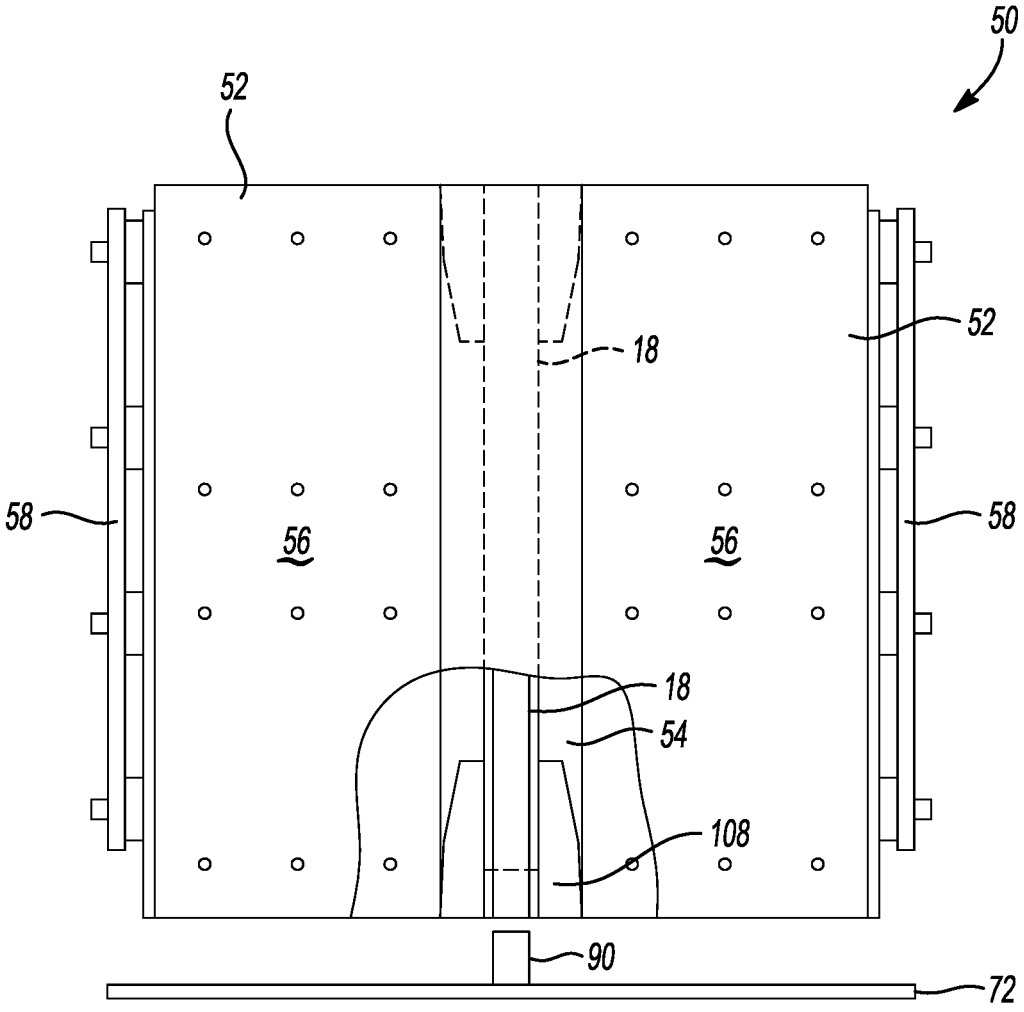
FIG. 17 is an elevation view of a seawall section partially fragmented to show the end core in one end that is removed after concrete is cast in the form.

FIG. 17 discloses a form 50 used to cast the seawall section 10 that includes a core 108 for forming the openings 98 in opposite ends of the seawall section 10. The form 50 is assembled to the base plate 72 and is centered on the protrusion 90. The pipe 18 extends through the seawall section 10 in the longitudinal direction. The pipe 18 remains in the seawall section after casting but the core 108 is removed after casting leaving an opening 98 for receiving the connector 94. Form caps 58 are shown at the outer ends of the form side walls 52.

Figure 18:
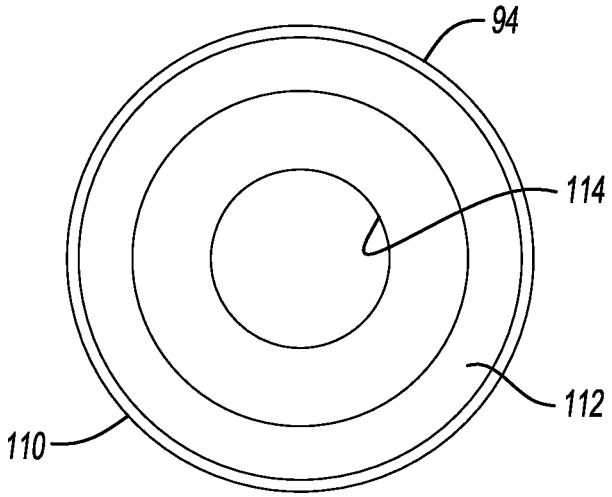
FIG. 18 is an end view of the connector.
Figure 19:
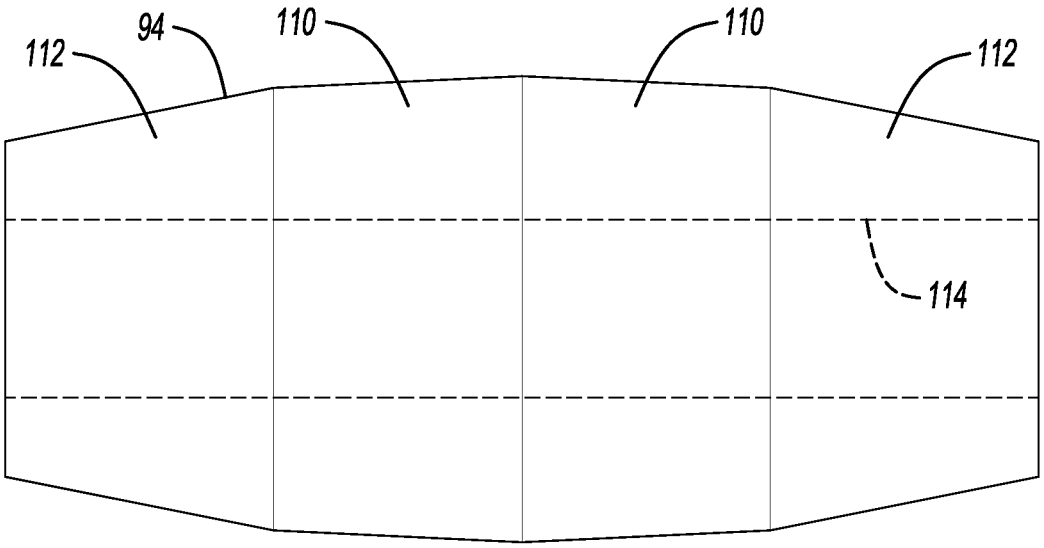
FIG. 19 is an elevation view of the connector.

FIGS. 18 and 19 show the connector 94 in an end view and an elevation view, respectively. The connector 94 includes a central portion 110 that is flanked by two tapered sections 112. A central hole 114 extends in the longitudinal direction and is adapted to receive the cable 22 (not shown in FIGS. 18 and 19) used to connect two adjacent seawall sections 10 and the connector 94 together. The tapered sections 112 are received in the openings 98 defined by each of the adjacent seawall sections 10.

One method of making a seawall section 10 is disclosed that begins with the step of assembling a rebar cage 38 and welding the rebar cage together. The rebar cage 38 has a plurality of longitudinally spaced pairs of parallel legs 40 that radially from a central hub 20 to an end rebar 46 that extends perpendicularly relative to the parallel legs 40. The end rebars 46 are connected to distal ends 44 of one of the pairs of parallel legs 40. The rebar cage 38 is then placed on the base plate 72. A plurality of V-shaped form side walls 52 are attached to the base plate 72 around the rebar cage 38. The V-shaped form side walls 52 define spacer attachment openings 26. Spacers 66 are then inserted between two adjacent V-shaped form side walls 52 in alignment with the spacer attachment openings 26. The spacers 66 are then secured with fasteners 68, 70 that hold the V-shaped form side walls 52 together as the seawall section 10 is formed. An end form cap 58 is assembled to each of two adjacent V-shaped form side walls 52. A casting space is defined by the V-shaped form side walls, the end form cap 58, and the casting space is then filled with a concrete mixture.

In one variation of the method, a pipe 18 is secured within the central hub 20 to a first protrusion attached to the base and a second projection attached to a top plate.

In another variation of the method, a seawall section is made by attaching one of the V-shaped walls to the base before placing the rebar cage on the base, and thereafter attaching the other V-shaped walls to the base to enclose the rebar cage.

The method may further comprise holding the spacers with an elongated member having at least one magnet at one end that magnetically retains one of the spacers between the V-shaped walls in alignment with the spacer attachment openings that are then retained by fasteners inserted in the spacers.

The method is completed by curing the concrete mixture to form the seawall section, disassembling the V-shaped walls from the seawall section and the base, and removing the spacers from the seawall section.

The embodiments described above are specific examples that do not describe all possible forms of the disclosure. The features of the illustrated embodiments may be combined to form further embodiments of the disclosed concepts. The words used in the specification are words of description rather than limitation.

What is claimed is:

1. A form for manufacturing a wall comprising:

a base including a planar plate that defines a plurality of holes;

a plurality of V-shaped walls attached at a lower end of the walls to the base, the walls being joined together to define a hub-forming space;

a plurality of end walls each being secured to radially outer ends of two adjacent V-shaped walls with a plurality of releasable fasteners;

a top plate attached to a top end of the V-shaped walls;

a first tube locating protrusion provided on the base and a second tube locating protrusion provided on a lower surface of the top plate, wherein the first and second tube locating protrusions are adapted to retain a pipe inside the hub forming space; and a plurality of spacers assembled between V-shaped walls in alignment with two openings defined by the adjacent V-shaped sidewalls; and a plurality of fasteners that each secure two of the V-shaped walls to one of the spacers.

2. The form for manufacturing a wall of claim 1 wherein the base further comprises:

channels provided on the lower surface of the base that are adapted to receive forklift tines.

3. The form for manufacturing a wall of claim 1 wherein the base defines access openings proximate each of the plurality of holes for providing access to the lower side of the base for fastening and unfastening the V-shaped walls to the base.

4. The form for manufacturing a wall of claim 1 wherein the spacers are tapered from a first end to a second end of the spacers to facilitate removing the spacers from the wall.

5. The form for manufacturing a wall of claim 1 wherein the releasable fasteners include pivotable bolts that extend between the end walls and the V-shaped walls, wherein a nut assembled to each of the pivotable bolts secures the V-shaped walls to the end walls.

6. The form for manufacturing a wall of claim 1 further comprising:

a rebar cage received within the V-shaped walls, the rebar cage including having a plurality of longitudinally spaced pairs of parallel rebars each pair extending radially from a central hub to an end rebar that extends perpendicularly relative to the parallel rebars, wherein the end rebars are connected to radially outer ends of one of the pairs of parallel rebars.

* * * * *